US005931768A

United States Patent [19]

Amesquita

[11] Patent Number: 5,931,768

[45] Date of Patent: Aug. 3, 1999

[54] ABDOMINAL AND LOWER BACK EXERCISE APPARATUS

[76] Inventor: Robert Amesquita, 1954 N. Raymond Ave., Pasadena, Calif. 91103

[21] Appl. No.: 08/669,894

[22] Filed: Jun. 21, 1996

[51] Int. Cl.[6] ..... A63B 23/02

[52] U.S. Cl. ..... 482/140; 482/96; 482/142; 482/907

[58] Field of Search ..... 482/10, 95, 92, 482/131, 132, 94, 140, 139, 142, 148, 907, 908, 146, 193; 606/240; 128/845, 869, 870; D21/191, 193; D24/190, 191; D29/102

[56] References Cited

U.S. PATENT DOCUMENTS

| | | | |
|---|---|---|---|
| D. 325,087 | 3/1992 | Brinker | D24/191 |
| D. 350,171 | 8/1994 | Kunewalder et al. | D21/191 |
| 2,533,273 | 12/1950 | MacGregor | 482/142 |
| 3,010,719 | 11/1961 | Johnson | 482/142 |
| 4,489,936 | 12/1984 | Dal Monte | 482/137 |
| 4,653,748 | 3/1987 | Seel et al. | 482/146 |
| 4,729,562 | 3/1988 | Pipasik | 482/94 |
| 4,752,067 | 6/1988 | Colonello | 482/142 |
| 4,951,939 | 8/1990 | Peters | 482/94 |
| 5,033,742 | 7/1991 | Johnson et al. | 482/140 |
| 5,085,429 | 2/1992 | Van Der Hoeven . | |
| 5,122,107 | 6/1992 | Gardner | 482/140 |
| 5,147,267 | 9/1992 | Kunewalder et al. | 482/96 |
| 5,160,304 | 11/1992 | Van Der Hoeven . | |
| 5,195,938 | 3/1993 | Robertson . | |
| 5,207,704 | 5/1993 | Shields | 606/240 |
| 5,300,004 | 4/1994 | Muehlenbein . | |
| 5,346,447 | 9/1994 | Stearns | 482/93 |
| 5,492,520 | 2/1996 | Brown | 482/132 |
| 5,545,144 | 8/1996 | Gvoich | 482/142 |
| 5,605,526 | 2/1997 | Hatfield | 482/142 |

OTHER PUBLICATIONS

"The Ab Bench," *Ironman* (May 1996), pp. 93–96, 98.

Advertisement for "Home Bench," *Ironman* (May 1996).

NordicTrack Early Summer Catalog 1996, p. 3.

Article about the "Tummyformer", dated Dec. 1983, class 482 subclass 140, Dec. 1983.

*Primary Examiner*—Jeanne M. Clark

*Attorney, Agent, or Firm*—Christie, Parker & Hale, LLP

[57] ABSTRACT

An abdominal exercise apparatus has an elongated rigid member for positioning between a user's back and a support surface for executing a crunch. A grasping mechanism, such as a strap member, is attached to the rigid member to allow the user to lift the head end of the rigid member from the support surface by contracting the abdominal muscles. A pivot member is connected to the rigid member adjacent the user's lower back and positioned to engage the support surface. A weight retaining mechanism, such as a post, adapted to receive weighted plates, may be attached to the rigid member to enhance the workout to the abdominal and lower back muscles.

13 Claims, 2 Drawing Sheets

ABDOMINAL AND LOWER BACK EXERCISE APPARATUS

FIELD OF INVENTION

The present invention relates to exercise devices and methods for isolating and strengthening the abdominal and lower back muscles.

BACKGROUND OF THE INVENTION

Traditionally, the sit-up has been the conventional method for strengthening the abdominal muscles. The sit-up is typically executed by placing one's back to the floor with the knees bent and the feet flatly secured to the floor. The hands are placed behind the head with the elbows extending forward. The head and shoulders are then lifted using the abdominal muscles until the elbows touch the knees and then the head and shoulders are lowered back to the zero degree surface of the floor. While this form of exercise has achieved moderate success in strengthening the abdominal muscles, several drawbacks and deficiencies are known to exist. For example, many muscle groups are indiscriminately exercised in addition to exercising the target muscles resulting in slow development of the abdominal muscles, and the full range of motion of the sit-up causes stress on the lower back and may exacerbate previous lower back or other injuries. Further, placing the hands behind the head during the sit-up stresses the neck muscles and forces the head into an extreme position with the chin against the chest. At the least, the neck muscles are strained, but this condition can also lead to neck injury or aggravation of old neck injuries.

Limited range of motion exercises, such as the "abdominal crunch," have been developed for reducing the stress on the lower back. The crunch is performed in a similar manner to the sit-up except that the head and shoulders are only raised a limited distance off the ground. However, optimal isolation of the abdominal muscles is still not achieved because additional leverage is often gained by using the hip flexor muscles to execute the movement. Moreover, additional muscle groups are utilized to counterbalance the weight of the legs thus reducing the isolation of the movement to the targeted abdominal muscles, and the neck is still strained.

Further, doing a sit-up or crunch on a flat surface only allows a limited workout of the abdominal and spinal erectors. The hip flexor muscles benefit more from this exercise on a flat surface. The Roman chair concept of doing an abdominal sit-up, where the gluteus is on the edge of the seat and you lean back past a flat or zero degree angle, produces a fuller range exercise by pre-stretching the abdominals and contracting the spinal erectors before contracting into the crunch position. This does not happen when doing a sit-up or crunch on a supported zero degree or flat surface. However, such strain is still encountered because the hands are placed behind the head.

Accordingly, there is a need for an exercise apparatus and method which provides maximum isolation to the abdominal muscles while at the same time reduces stress to the back and neck.

SUMMARY OF THE INVENTION

The present invention is directed to an apparatus and method for isolating and strengthening the abdominal muscles. There is provided, in a preferred embodiment, an abdominal exercise apparatus having an elongated rigid member having pivot and head ends. The rigid member includes an upper surface of sufficient size and shape for supporting the back and the head of a user and a lower surface for positioning on a support surface. A grasping means is attached near the head end of the rigid member to allow the user to lift the head end of the rigid member from the support surface by contracting the abdominal muscles. A preferred grasping means is constructed from a strap member having loops extending outwardly from the rigid member.

Preferably, a pivot member is connected at or near the pivot end of the rigid member for engaging the support surface. The pivot member is preferably formed with a rounded lower surface and may include a high friction surface for gripping the support surface. In one embodiment, the pivot member also includes a flat portion for attachment to the rigid member.

A means for adjusting the resistance on the abdominal muscles during the lifting of the head end of the rigid member may also be provided. For example, an L-shaped post attached to the rigid member adapted to receive weighted plates is one way of implementing this feature.

The abdominal muscles are strengthened by positioning the rigid member between the back of the user and the support surface, the head end supporting the upper back and the head of the user and the pivot end supporting the lower back of the user. The grasping means, e.g., a strap member, extend upwardly on opposite sides of the user's neck to a position above the shoulders when the user is in a supine position. The user holds the grasping means of the rigid member and contracts the abdominal muscles. This raises the head end of the rigid member off the support surface while the pivot end remains pivotally engaged with the support surface. Preferably, the user momentarily holds the raised head end of the rigid member at the top of the movement to further enhance the benefit to the target muscles. The user then slowly lowers the raised head end of the rigid member back to the support surface.

An attractive feature of an embodiment of the present invention is that the rigid member makes the crunch easier to execute while at the same time provides maximum isolation to the abdominal muscles. Since the abdominal muscles are well isolated, the use of the hip flexor muscles are avoided rendering the leg position of the user irrelevant. Consequently, the weight of the legs become stabilized and do not require counterbalancing. Moreover, by positioning the rigid member so as to support the head, neck and the back during the execution of the crunch, the potential for injury is greatly reduced.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
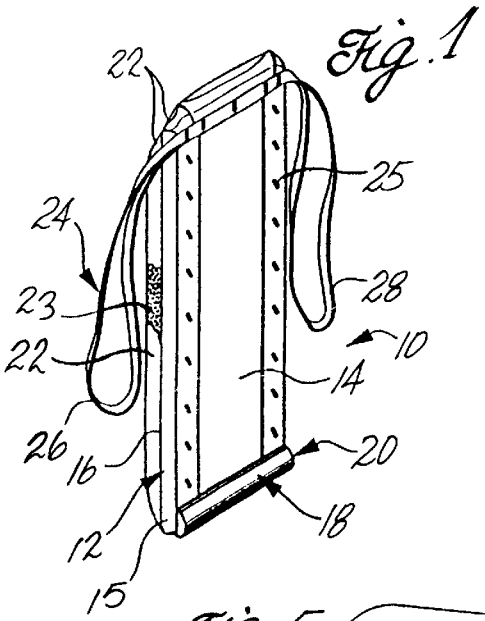
FIG. 1 is a perspective view of an embodiment of the abdominal exercise apparatus.

The abdominal exercise apparatus, generally designated 10, according to a preferred embodiment of the present invention, is shown in FIG. 1. The abdominal exercise apparatus 10 is used to perform crunches and includes a rigid member 12 of sufficient size and shape for supporting a user's back and head in a straight line. The rigid member 12 is elongated between a first end (head end) 22 for supporting the head of the user and a second end (pivot end) 15 for supporting the lower back during the execution of a crunch. To execute a crunch, the head end is lifted off the ground by the user thereby pivoting the rigid member about the pivot end.

The rigid member 12 is preferably a wood board or plastic panel having a substantially rectangular shape; however, it will be appreciated that any structure capable of providing back support can be used. Exemplary dimensions of the rigid member are 7 to 12 inches wide by 16 to 28 inches long. The rigid member is preferably 24 inches long. Eighteen inches provides enough length for a typical user to rest his or her head, specifically, the external occipital protuberance of the occipital bone, on the rigid member and still have the rigid member extend down to the user's lower back for providing maximum isolation to the abdominal muscles. A width of 10 inches has been found to be sufficiently wide to provide a comfortable supporting surface during use for even large users.

The rigid member 12 has a bottom surface 14 for positioning on a support surface 13 (FIG. 10), such as a floor. An upper surface 16 of the board supports the back and head of the user. A pivot member 18 is preferably secured to the bottom surface 14 near the pivot end 15 of the rigid member. Thus, the pivot member is positioned adjacent the user's lower back, and the board is pivoted on the pivot member during crunches. The pivot member enhances the smoothness of the pivoting motion during the execution of the crunch. The pivot member is shown as a half-cylinder made of wood extending across the entire width of the rigid member. It is understood that plastic or any other suitable material may also be used. Exemplary dimensions of the pivot member are 7 to 10 inches long having a cylindrical radius of ½ to 1 ½ of an inch. It is understood that the pivot member may be formed in any shape sufficient to facilitate a pivotal motion of the pivot end 15 of the rigid member with the support surface.

As an optional feature, the pivot member 18 may be covered with an elastomeric sleeve or coating 20 to provide a high friction surface for creating a friction medium between the support surface and the pivot member 18 so that the abdominal exercise apparatus 10 does not slip during the execution of the crunch. For additional friction the sleeve or coating may be formed with a knurled or otherwise textured surface.

The upper surface 16 of rigid member is preferably covered with a vinyl or similar material 22 to minimize the potential for irritation of the user's back. Further comfort to the user is provided by disposing a padding substance 23, such as foam, between the vinyl cover 22 and the rigid member 12. The vinyl cover completely covers the upper surface 16 and extends around the sides of the rigid member 12 to the bottom surface 14 and is secured to the bottom surface with any conventional means such as staples 25. Thus, the head and back of the user engage the padding instead of the hard rigid member 12.

A grasping means (mechanism), such as a strap member 24, is secured to the rigid member 12 so that the user can pull on the rigid member 12 during the upward motion of the crunch. The strap member is made from, by way of example, a woven nylon webbing or other suitable flexible lightweight material having a high tensile strength. In the described embodiment, the strap member 24 is formed from a single length of strap, each end of the strap being attached to opposite sides of the bottom surface of the rigid member. The center of the strap is secured along the width of the bottom surface to the rigid member 12 and over the ends of the strap to form two loops 26, 28 extending outwardly from both sides. The strap member 24 is preferably 6 feet long so that the loops extend 1 to 1½ feet beyond the sides of the rigid member when the strap member is secured to the bottom surface 14 of the rigid member in a manner described above. If desired, the strap member 24 can be extended so that even a one-armed user could exercise with the apparatus by laying the straps across the shoulders and holding them centrally on the chest with the one hand. Preferably, each loop 26, 28 is equipped with an adjusting mechanism 29 (FIG. 5) for lengthening or shortening the loops to accommodate different users and adjusts the lifting force as described below.

Figure 2:
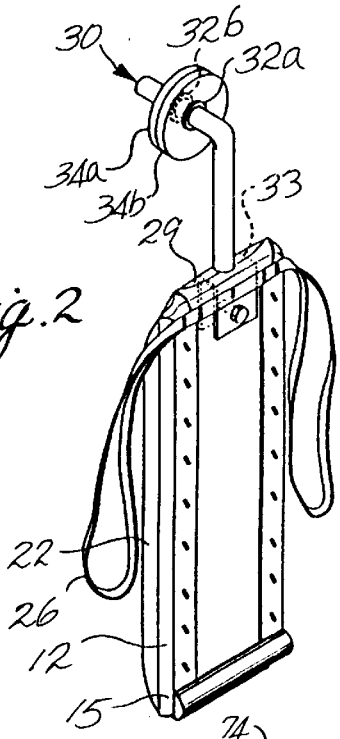
FIG. 2 is a perspective view of an embodiment of the abdominal exercise apparatus employing a post for stacking weighted plates.

As an optional feature, as shown in FIG. 2, the rigid member 12 may be formed with a weight retaining mechanism preferably an L-shaped post 30 extending from the upper portion 29 of the rigid member 12 along the elongated axis for receiving weighted plates 34*a*, 34*b*. The L-shaped post provides a means for increasing or decreasing the resistance on the user's abdominal muscles. The L-shaped post 30 is formed of a suitably sturdy material such as aluminum or stainless steel and preferably includes a bracket 33 at one end for fixedly attaching the post 30 to the rigid member 12. When increased loading of the abdominal muscles is desired, the rigid member 12 should be reinforced, by way of example, with a metal sheet (not shown) to help distribute the load over a larger surface area. Preferably, the post is of sufficient size and diameter to support a standard bar bell weighted plate used in most commercial gymnasiums. For increased safety, clamping means 32*a*, 32*b* may be provided for securing the weighted plates 34*a*, 34*b* to the post 30 during the execution of the crunch.

Figure 3:
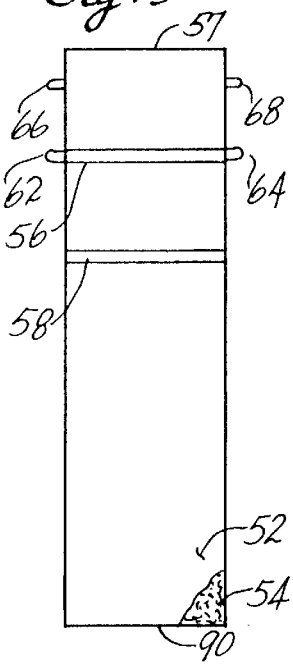
FIG. 3 is a front plan view of an alternate embodiment of the abdominal exercise apparatus.
Figure 4:
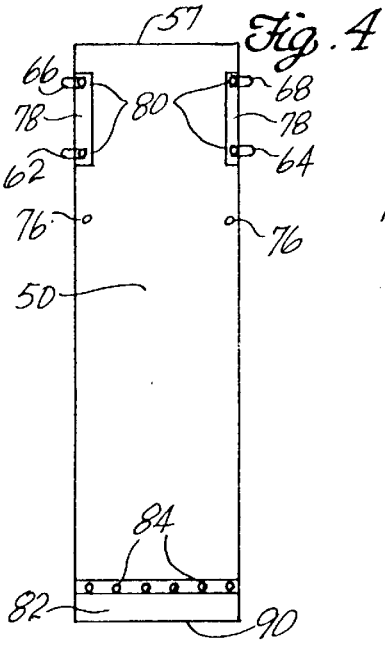
FIG. 4 is a rear plan view of the abdominal exercise apparatus of FIG. 3.

An alternate embodiment of the invention is illustrated in FIGS. 3 and 4. The board 50 is again covered with a vinyl cover 52 and a foam pad 54. This embodiment provides an upper reference strip 56 (closer to the head end 57) and a lower reference strip 58. As will be discussed below, moving the board up and down the user's back adjusts the force required to perform a crunch. Thus, the reference strips allow the user to know where to position the board for exercising. Further, they allow the user to measure progress. As the user increases in strength and moves his or her head toward the head end of the board (making the crunch more difficult), the user can tell how far up the board his or her head has moved by measuring relative to the reference strips. The reference strips also allow a user to quickly set up a work-out comprising groups of hard and groups of easy crunches.

Figure 5:
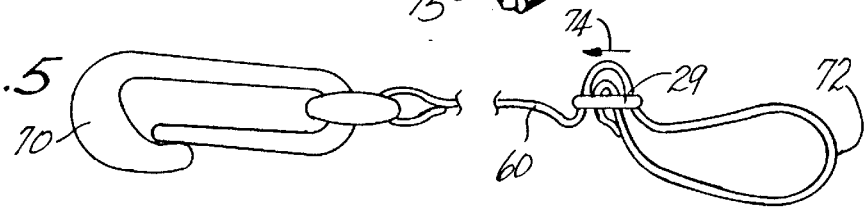
FIG. 5 is a schematic view of a strap used with the abdominal exercise apparatus of FIG. 3.

Referring additionally to FIG. 5, the straps 60 are attached to connection loops 62, 64, 66, 68 with clips 70 attached to the ends of the straps. The other end of the straps form handle loops 72 with an adjusting mechanism 29. To lengthen the strap making the loop smaller, the strap is pulled through the adjusting mechanism in a direction illustrated by arrow 74 toward the board. To shorten the strap making the loop larger, the strap is pulled through the adjusting mechanism in a direction away from the board, opposite the direction indicated by the arrow 74. To lock the strap length, the strap is pulled tight in the adjusting mechanisms creating a friction lock.

Two sets of rigid, U-shaped strap connectors are provided. The lower set of connectors 62, 64 is used for a more difficult work out while the upper set of connectors 66, 68 closer to the head end 57 is used for a lighter work out. The connectors are welded to brackets 78 which are attached to the back of the board with conventional fasteners 80. An additional set of predrilled holes 76 is provided to move the bracket 78 and the connection loop farther down the board to further increase the intensity of the crunches. The user may also drill custom holes.

Figure 6:
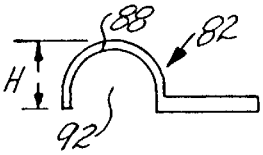
FIG. 6 is a side plan view of a pivot member used with the abdominal exercise apparatus of FIG. 3.

As in the previous embodiment, a pivot member 82, having a rounded portion 88 and a flat portion 86 for attaching to the board, is attached to the pivot end with conventional fasteners 84. Referring additionally to FIG. 6, the pivot member is attached to the board so that a rounded portion 88 is closest to the pivot end 90. The pivot member shown is a unitary piece of rolled steel, but it may be fabricated by attaching several parts together. The rounded portion has a height varying between approximately ¾ inch and approximately 1½ inch. The pivot member with this configuration could also be fabricated as a solid piece, that has no opening 92, and be made of wood, plastic, or other suitable material. The pivot member could also comprise a metal tubular member with a flat compressed into the tube to provide a flat surface to engage the board.

The exercise apparatus is preferably provided as a kit with a 1 inch high pivot member preattached to the board, an unattached 1½ inch high pivot member, and an allen wrench. The allen wrench would loosen the fasteners 84 (allen head screws) to change to the higher pivot member when the user is ready for a more intense workout. The fasteners 80 for the brackets 78 would also be allen head screws.

Figure 7:
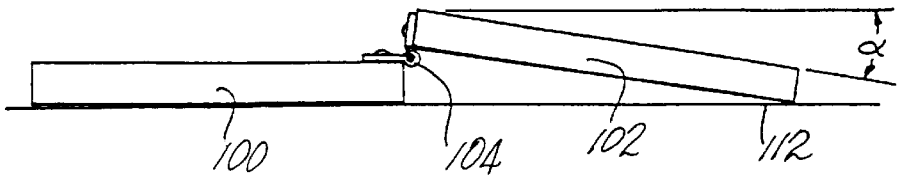
FIG. 7 is a schematic view of an alternate abdominal exercise apparatus with a platform and a hinge acting as a pivot member.
Figure 9:
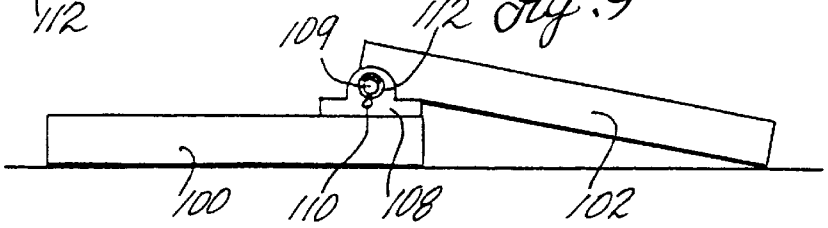
FIG. 9 is a schematic plan view of the abdominal exercise apparatus of FIG. 7 with a shaft and pillow block assembly replacing the hinge.
Figure 8:
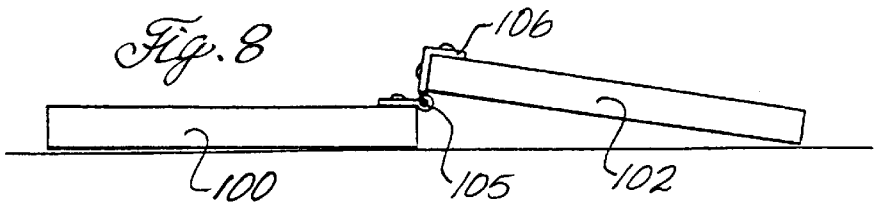
FIG. 8 is a schematic plan view of the abdominal exercise apparatus of FIG. 7 with a hinge having a top plate.

In the embodiments of FIGS. 7, 8, and 9, a platform 100 is pivotally attached to a back board (rigid member) 102. In FIG. 7, the platform is attached to the back board with a typical hinge 104. In FIG. 8, the hinge 105 is provided with a top plate 106 to provide a more secure connection to the back board. In FIG. 9, a pair of pillow blocks 108 is attached to the platform. A shaft 109 is extended through the pillow blocks and fixed with cotter pins 110 or other conventional means. This is referred to as a pillow block and shaft assembly. Preferably, a washer 112 is interposed between the cotter pins and the pillow block to assure free rotation. The back board is attached either rotatably or fixedly to the shaft with another pair of pillow blocks (not shown) or conventional fasteners (not shown) respectively. In the embodiments of FIGS. 7, 8, and 9, the hinges and the shaft/pillow block assembly are the pivot members. The strap members are fastened to the back board as in the previous embodiment.

Figure 10:
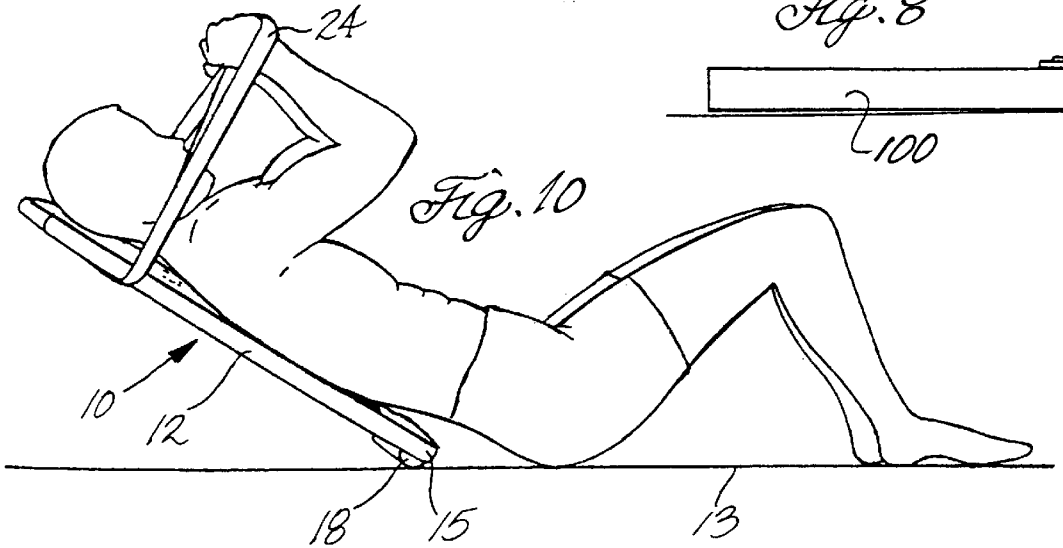
FIG. 10 is a demonstrative view showing an embodiment of the abdominal exercise apparatus being manipulated by a user.

In FIG. 10, an embodiment of the abdominal exercise apparatus is shown being manipulated by a user. In operation, the user positions the abdominal exercise apparatus on a support surface. The support surface is preferably horizontal, but may be an inclined surface to increase or decrease the resistance to the abdominal muscles during the upward motion of the exercise. The user assumes a supine position with his or her back and head on the upper surface and head end of the elongated rigid member. The pivot member is positioned under the user's lower back, and the loops of the strap members extending upwardly to a position above the shoulders. The hands are placed in the loops of the strap member with the elbows extending forward. The head, thorax, shoulders, back, and abdomen are then lifted off the support surface by contracting the abdominal muscles while simultaneously pulling the strap members toward the knees. A momentary pause is preferably executed at the top of the motion and then the head and shoulders are slowly lowered to the support surface.

In the platform embodiments, the user places the buttocks on the platform and lays the back on the back board. The crunch is then completed as described. The execution of the crunch may be repeated until the abdominal muscles are sufficiently worked. The oblique abdominal muscles may be exercised by crossing one leg over the other in a bent position to lay slightly on one side on the board and then performing the crunch. The opposite oblique muscles are exercised by switching the legs.

In the embodiments of FIGS. 1, 2, and 4 and to a greater extent in the embodiments of FIGS. 7, 8, and 9, the back muscles are also exercised because of a negative incline angle $\alpha$ (FIG. 7). To increase the intensity of exercise in the back muscles, the negative incline angle or decline angle $\alpha$ is increased by increasing the height H of the pivot member, inclining the support surface 13 so that the head end is lower than the pivot end, and lowering the portion of the support surface 112 underneath the head end or backing board. The negative incline angle also stretches the abdominal muscles. Thus, the negative incline angle exercises the back muscles without interfering with the exercise of the abdominal muscles, and it even aids exercising the abdominal muscles because of the stretching it creates. With these adjustments, it is apparent that the exercise apparatus changes with the user.

Another benefit of the exercise apparatus is the exercise of the arm muscles. Different arm muscles are exercised by rotating the hands in the loops of the straps. The palms are positioned upwardly, facing each other, and away from each other to exercise the arms differently. The arms are also positionable straight or bent. If a user desires to exercise the hip flexors also, the user can simply lift the legs. Neither exercising the arms or the hip flexors interferes with exercising the abdominal and lower back (spinal erector) muscles.

Although increased loading to the abdominal muscles can be achieved by adding weights to the L-shaped post, significant changes in the load can be made by adjusting the position of the exercise apparatus up and down the users back. When the exercise apparatus is moved downwardly on the back and thus the head moves in a direction from the lower reference strip to the upper reference strip, the crunch becomes more difficult. When the exercise apparatus is moved in the opposite direction, the crunch is made easier. Thus, adjusting the position of the apparatus provides another means for adjusting the load lifted by the abdominal muscles.

Another means for adjusting the intensity of the crunch is provided by the two connection loop sets and the movable bracket. The farther away from the head end of the board that the straps are connected to the board, the harder the crunch is. Thus, when the bracket is moved to the additional set of predrilled holes and the straps are clipped onto the connectors closest to the pivot end of the board, the crunch is made harder. The crunch can be made even more difficult if the user drills additional holes closer to the pivot end of the board. The exercise is also made more difficult by shortening the straps.

Still another means for adjusting the difficulty of the crunch is provided by the pivot member. If the height of the pivot member is increased, the lifting distance is increased and the negative incline angle $\alpha$ is also increased, thus exercising the abdominal muscles and the back muscles to a greater extent.

Thus, a raised pivoting device is placed on the underside of the bottom end of a board at one edge. The board is laid on a flat support surface. A person lays on his back on the board, with the lower back on the raised pivot bottom end of the board and the head supported towards the top end of the board. By having the surface of the board support the head, neck, shoulders, and back in a straight line, the stress of bending the neck forward doing a conventional sit-up or crunch with only the hands for support, is eliminated. The hip flexor muscles play no part in the crunch exercise, allowing the abdominals to develop more completely in a shorter period of time. By putting the raised pivot member on the bottom underside of the lower edge of the rigid member, the raised pivot member allows the person to return from the forward crunch, to a decline angle in relation to the attached top of the pivot member. By being placed in a decline angle, the abdominal muscles are stretched and the lower back spinal erectors are contracted. This action provides for a more thorough exercise of the abdominal muscle than conventional sit-ups and known abdominal exercise apparatuses.

Two web straps are added to the board to assist in raising the board on its pivot. The hands are placed in the strap loops and in a straight line with the body over the top of the head, or any other angle, over the face or the shoulders or down to the chest. The arms can also be placed out to the side, like a cross formation. The hands can be positioned in the strap loops facing each other, or away from each other, facing the head or feet. The various placements produce different degrees of resistance. By holding onto the straps, an isometric exercise condition occurs for the arms, and gain is experienced in strength and muscle growth in the arms, chest, and upper back areas.

By use of this apparatus, the abdominal and lower back muscles are isolated. That is, the hip flexors are noticeably relaxed and the user's legs can be placed in any position without interfering with the exercise. Thus, the apparatus and method eliminate the need to counter balance the weight of the legs. Further, the head is supported avoiding neck strain, and the present invention can make a crunch easier to avoid muscle strain at the beginning of an exercise program.

It is apparent from the foregoing that an embodiment of the present invention satisfies an immediate need for an exercise apparatus which provides maximum isolation to the abdominal muscles while at the same time reduces the stress to the back. This abdominal exercise apparatus may be embodied in other forms without departing from the spirit or essential attributes of the present invention.

For example, the grasping means is described in the preferred embodiment as flexible loops. It is understood that means, including rigid posts, which extend from the sides of the rigid member upwardly to a position above the shoulders of the user, may be used. As another illustration, rather than an L-shaped post for receiving additional weights, the rigid member may extend above the users head a distance sufficient to provide a surface for receiving weights. On such an embodiment, a vertical post or other means may be provided to secure the weights to the rigid member. Further, a part for receiving additional weights can be provided on a bar inserted into a slot in the rigid member and held therein with fasteners. This would allow the rigid member to range fully in the decline angle. The bar can be bent upwardly or stepped to assure that the end of the bar opposite the slot of the rigid member does not contact the support surface and thus does not interfere with the range of the decline angle. Still further, the reference strips could be painted reference lines or just a different color or texture inherent to the cover.

It is therefore desired that the present embodiment be considered in all respects as illustrative and not restrictive, reference being made to the appended claims rather than the foregoing description to indicate the scope of the invention.

What is claimed is:

1. An abdominal exercise apparatus comprising:

a rigid member having an upper surface for supporting the head, neck, shoulders, and back of a user and a lower surface for positioning on a support surface, said rigid member having a head end for supporting at least the external occipital protuberance of the user and a pivot end for supporting the lower back of the user wherein the head end terminates at a head edge and wherein the pivot end terminates at a pivot edge;

flexible grasping means coupled to the head end; and a pivot member connected to the rigid member immediately adjacent the pivot edge allowing for the rotation of the apparatus about the pivot end, wherein the rigid member is elevated at the pivot end.

2. The abdominal exercise apparatus of claim 1 wherein the pivot member has a rounded lower surface for engaging the support surface, and a flat portion for attachment to the rigid member.

3. The abdominal exercise apparatus of claim 1 wherein said pivot member comprises a high friction surface for nonslidably engaging the support surface.

4. The abdominal exercise apparatus of claim 1 wherein the rigid member has a generally rectangular shape, and the upper surface of the rigid member is padded.

5. The abdominal exercise apparatus of claim 1 wherein said grasping means comprises two strap members extending outwardly from opposite sides of the rigid member.

6. The abdominal exercise apparatus of claim 5 wherein said strap member is formed with loops and comprises an adjustment mechanism.

7. The abdominal exercise apparatus of claim 1 further comprising means for adjusting the resistance on the user's abdominal muscles during the lifting of the head end of the rigid member, and at least two reference strips on the upper surface.

8. The abdominal exercise apparatus of claim 7 wherein the means for adjusting the resistance comprises a post attached at the head end of the rigid member for receiving weighted plates.

9. The abdominal exercise apparatus of claim 8 wherein the post is substantially L-shaped.

10. The abdominal exercise apparatus of claim 7 wherein the means for adjusting the resistance comprises two sets of strap connectors spaced apart along the length of the rigid member and two straps for connecting to the strap connectors.

11. The abdominal exercise apparatus of claim 7 wherein the means for adjusting the resistance comprises a second pivot member having a different height than the pivot member for replacing the pivot member to enhance the negative lowering of the rigid member to exercise and strengthen the spinal erector muscles and stretch the abdominal muscles.

12. An abdominal exercise apparatus for isolating the abdominal muscles during exercising comprising:

a rigid member positionable between a back of a user and a position for supporting the head of a user and a support surface;

flexible grasping means connected adjacent a head end of the rigid member for grasping by the user to lift the head end from the support surface when the abdominal muscles are contracted; and a pivot member attached immediately adjacent a pivot edge of the rigid member allowing for the rotation of the apparatus about the pivot member, wherein the rigid member is elevated at the pivot edge.

13. The apparatus of claim 12 wherein the rigid member comprises a board having a length of approximately 24 inches.

* * * * *